United States Patent [19]

Wilke

[11] 4,040,438

[45] Aug. 9, 1977

[54] CONTROL VALVE WITH FLOW CONTROL MEANS

[75] Inventor: Raud A. Wilke, Brookfield, Wis.

[73] Assignee: Koehring, Milwaukee, Wis.

[21] Appl. No.: 653,824

[22] Filed: Jan. 30, 1976

Related U.S. Application Data

[60] Division of Ser. No. 462,038, April 18, 1974, Pat. No. 3,951,162, which is a continuation-in-part of Ser. No. 195,145, Nov. 3, 1971, abandoned.

[51] Int. Cl.[2] ..... F15B 11/08

[52] U.S. Cl. ..... 137/106; 91/421; 137/596.13

[58] Field of Search ..... 137/106, 115, 596.12, 137/596.13; 91/421

[56] References Cited

U.S. PATENT DOCUMENTS

| | | | |
|---|---|---|---|
| 1,964,196 | 6/1934 | Cuttat | 91/421 |
| 2,501,483 | 3/1950 | Taylor | 91/421 |
| 3,225,781 | 12/1965 | Kruger | 137/115 X |
| 3,398,650 | 8/1968 | Garnjost | 91/421 |
| 3,613,711 | 10/1971 | Wilke | 137/115 |

*Primary Examiner*—Robert G. Nilson

[57] ABSTRACT

A control valve having a pair of service passages for connection with the opposite sides of a reversible fluid motor, wherein a flow control valve for each service passage restricts exhaust flow therethrough to prevent the pressure thereof from exceeding a predetermined value, but in no way influences flow to a fluid motor of supply pressure fluid from its service passage. Flow coordinating means limits flow of supply fluid to each service passage substantially in correspondence with restricted flow of motor exhaust fluid in the other service passage.

5 Claims, 2 Drawing Figures

CONTROL VALVE WITH FLOW CONTROL MEANS

This application is a division of U.S. Patent application Ser. No. 462,038 filed Apr. 18, 1974, (now U.S. Pat. No. 3,951,162) which, in turn, is a continuation-in-part of U.S. Patent application Ser. No. 195,145 filed Nov. 3, 1971, and now abandoned.

This invention relates to control valves for governing the operation of reversible fluid motors, and it has more particular reference to speed and directional control valves for such motors.

In general, it is the purpose of this invention to provide a control valve for reversible fluid motors by which the speed of motor operation can be curtailed at such times as the load on the motor tends to drive it at a rate faster than pressure fluid from a source can be supplied to it.

Hence, it is an objective of the invention to provide a control valve for fluid motors in which flow controlling means functions to limit return fluid flow from the governed motor whenever the pressure of such return fluid reaches a predetermined value.

It is a more specific object of this invention to provide a control valve with return flow controlling means such as described above, and which also embodies means for limiting flow of supply fluid to the governed motor whenever return flow therefrom is being restricted by the flow controlling means.

Another object of the invention resides in the provision of a control valve such as described in the preceding paragraph wherein a bypass valve is rendered operative to pass part of the supply pressure fluid in an inlet passage to return passage means at times when the flow controlling valve means limits return fluid flow in one or in both service passages, and wherein the same bypass valve is rendered operative to dump all the supply fluid in the inlet passage to the return passage means as a consequence of return of the valve element to its neutral position.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

Figure 1:
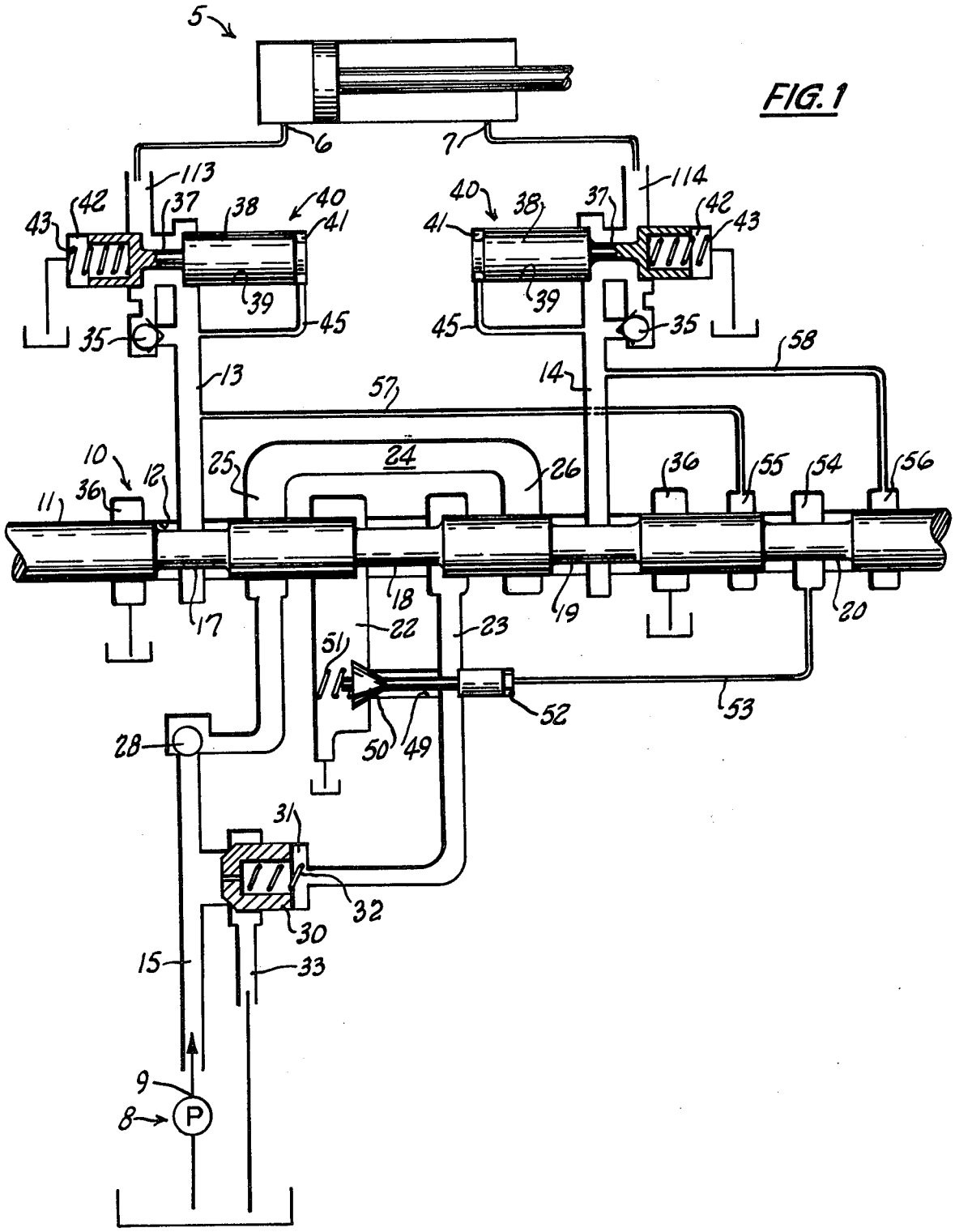
Figure 2:
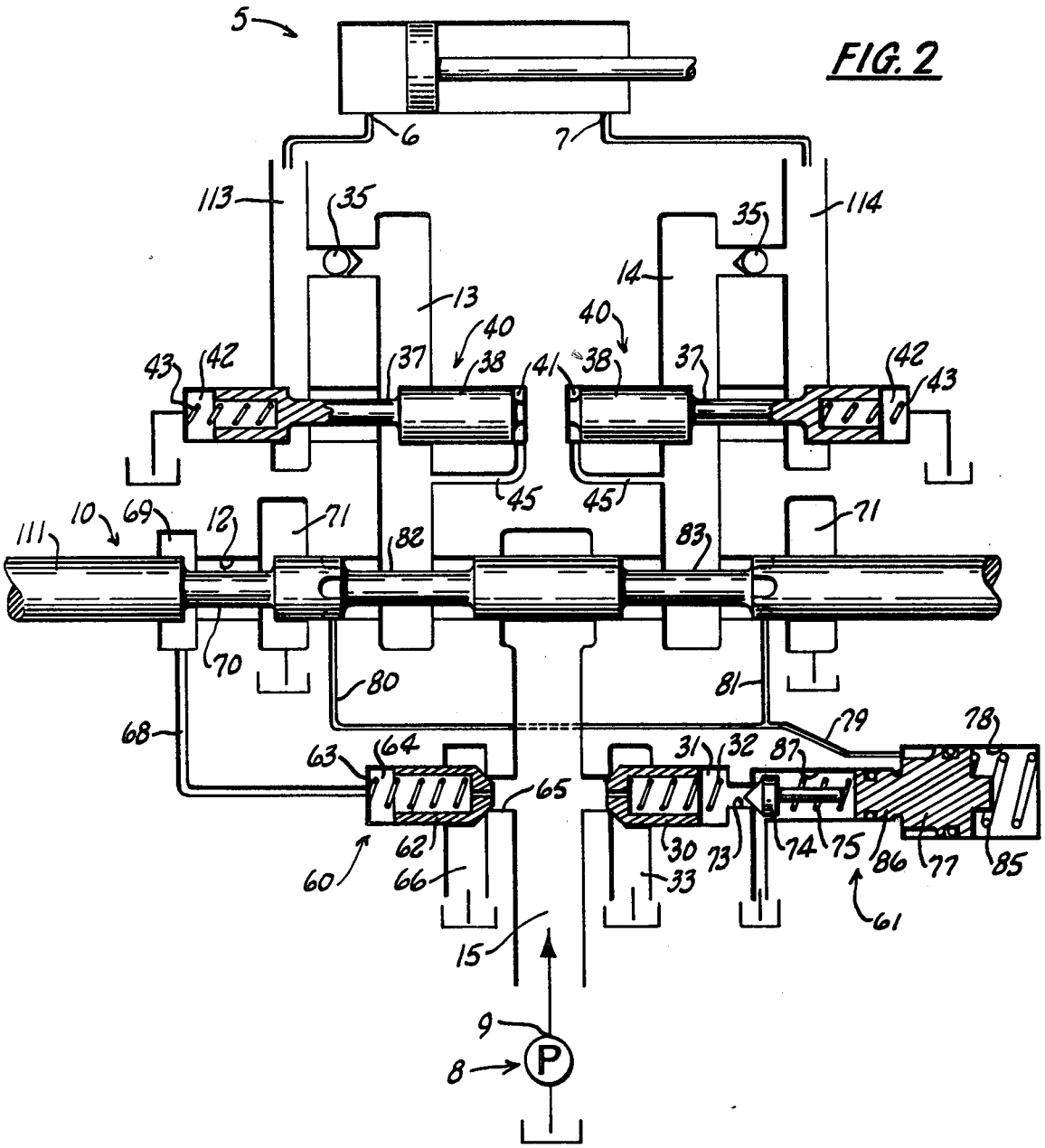

The accompanying drawings illustrate two complete examples of embodiments of the invention constructed according to the best modes so far devised for the practical application of the principles thereof, and in which:

FIG. 1 is a diagrammatic representation of a fluid pressure operated system governed by a control valve of this invention; and FIG. 2 is a view similar to FIG. 1 but illustrating a control valve of modified construction.

Referring now to the accompanying drawings, the numeral 5 generally designates a reversible fluid motor in the form of a double acting cylinder having ports 6 and 7 in its opposite ends. The numeral 8 generally designates a pump having a pressure fluid outlet 9 from which pressure fluid is supplied to one port or the other of the motor at the dictate of a control valve 10 of this invention.

The control valve has a spool type valve element 11 which is slidable axially in a bore 12 in the body of the valve from a neutral position shown to each of two operating positions at opposite sides of neutral to communicate a selected one of a pair of service passages 13, 14 with a pump fed inlet or supply passage 15, while communicating the non-selected service passage with pressure fluid return means. Reservoir symbols designate various return or tank passages as well as the actual reservoir with which the inlet of the pump is connected.

The control valve shown by way of illustration in FIG. 1 has four circumferential grooves 17, 18, 19 and 20, reading from left to right, and lands at axially opposite sides of each groove. In the neutral position of the spool, its grooves 17 and 19 register with the junctions between the bore and service passages 13, 14, while the center groove 18 spans the junctions of the bore with two axially adjacent passages 22 and 23 and thus serves to communicate the latter with one another through the bore.

An inverted U-shaped bridge or feeder passage 24 has opposite legs 25,26, one for each of the service passages to conduct supply pressure fluid thereto. Bridge leg 25 joins with the bore 12 at a location between service passage 13 and passage 22, while bridge leg 26 joins with the bore at a location between service passage 14 and passage 23. The supply passage 15 connects with bridge leg 25 through a load holding check valve 28.

The output of the pump 8 is normally dumped through a bypass valve 30 which operates in a chamber 31 and is urged by a spring 32 toward a closed position blocking flow of fluid from the supply passage 15 to return passage means comprising a reservoir connected passage 33. Pressure fluid in the supply passage exerts opening force on the front of the bypass valve 30, and it also flows through an orifice in the front of the valve to the space in chamber 31 behind it to thus exert closing force thereon. Hence, the spring is able to hold the bypass valve closed except at times when the space in chamber 31 behind the valve is vented. In the neutral position of the control spool 11, this chamber is vented through passages 22 and 23, the annular groove 18 in the spool and the bore in which the spool operates.

As a result, all of the pump fluid entering the supply passage 15 will continue to dump to the tank passage 33 until such time as the valve spool 11 is moved out of its neutral position to one or the other of its operating positions. At that time the lands at one side or the other of spool groove 18 close off communication between the two branches 22 and 23 comprising the chamber venting passage so that pressure fluid from the supply passage 15 will then be trapped in the chamber 31 behind the bypass valve 30, and the latter will close under the force of its spring 32.

If the valve spool is moved to an operating position to the right of neutral to effect such closing of the bypass valve, pressure fluid in the supply passage 15 will flow through the load holding check valve 28 to leg 25 of bridge 24, and through annular spool groove 17 to service passage 13 for flow therefrom to motor port 6.

It should here be observed that the service passages 13,14 have outer branches 113 and 114 respectively, with which they are communicable through check valves 35. Each such check valve is arranged to open to pass pressure fluid from the inner to the outer branch of its service passage.

In the right hand working position described, therefore, pressure fluid flows to the piston side of the cylinder 5 from the outer service passage branch, 113 after being passed through the associated check valve 35.

Fluid expelled from the rod side of the cylinder is returned to the outer branch 114 of service passage 14 for flow to tank via an exhaust passage 36, through the bore 12 and annular groove 19 in the valve spool 11. However, since check valve 35 blocks direct communication between service passage branches 14 and 114, such return fluid is compelled to flow along a path which leads from the outer service passage branch 114 to the inner branch 14 through an annular groove 37 in a spool type valve member or plunger 38 which is axially slidable in the bore 39 of a flow control valve 40. A duplicate of this flow control valve is provided for the service passage 13,113, to similarly control flow to tank of fluid expelled from the piston side of the cylinder 5. It should be noted, however, that the two branches of each service passage intersect the bore 39 of its flow control valve, at axially spaced but adjacent locations.

The opposite end portions of the bore 39 are closed and provide an actuating chamber 41 and a spring chamber 42 containing a coil spring 43 which yieldingly urges the plunger 38 toward the chamber 41, to a position at which its annular groove 37 spans the space in bore 39 between the junction of the latter with service passage branches 14,114. At that position, the valve member or plunger 38 provides for substantially free flow of motor exhaust fluid from the outer service passage branch 114 to the inner branch 14.

The spring chamber 42 is vented to the return passage means, while the actuating chamber 41 is connected by a control duct 45 with the inner service passage branch 14. Consequently, the chamber 41 will always contain fluid at the pressure which obtains in service passage branch 14.

In the right hand operating position of the valve spool 11 described eariler, pressure fluid exhausting from the port 7 in the rod end of cylinder 5 will flow substantially freely to the return passage 36 as long as such pressure fluid is expelled at a normal rate. A normal rate of exhaust flow from motor port 7, for example, can be said to obtain when pressure fluid directed into cylinder port 6 effects lifting of a load on the piston rod.

In many hydraulically operated systems, however, there will be times when pressure fluid is delivered to the piston end of cylinder 5 through its port 6, and the load connected to the piston rod effects extension thereof at a rate faster than pressure fluid can be supplied to the extending end of the cylinder from the pump. When that occurs, the pressure in the contracting rod end of the cylinder and in service passage 14,114 rises, and there is danger of not only drawing a void in the expanding end of the cylinder but of losing control over the load.

According to this invention, however, if the load on the piston rod effects undesirably rapid extension thereof, the accompanying rise in the pressure of motor exhaust fluid in service passage 14 will be manifested in the actuating chamber 41 of the flow control valve for said service passage. When the flow rate of motor exhaust fluid in the service passage increases to an extent at which the fluid pressure force imposed upon the plunger 38 in actuating chamber 41 exceeds the force of spring 42, the plunger is moved in the flow restricting direction, toward the spring chamber, to a position limiting flow to the inner branch 14 of the service passage. If the pressure of motor exhaust fluid then remains at a constant excessive value, the plunger will assume a stable flow restricting position at which the force exerted thereon by pressure of fluid in chamber 41 balances the force imposed thereon by its spring 43. This stable flow restricting position may be one which effects a reduction in fluid pressure in service passage branch 14 to 100 psi, for example, and depends upon the strength of the spring 43.

Should the pressure of motor exhaust fluid returning to the outer service passage branch 114 continue to rise, the pressure in the inner service passage branch 14 and in actuating chamber 41 will rise correspondingly, to thereby cause the flow controlling plunger 38 to be moved farther toward the spring chamber 42 and thus further decreased flow to the inner service passage branch 14. In this way, the pressure in the inner service passage branch 14 can be kept from rising beyond a predetermined value, say of 100 psi, regardless of the rise in pressure in the outer branch 114 of the service passage.

The flow control valve 40 for service passage 13,113 functions to restrict return flow from the piston end of the cylinder 5 in the same way as described above, when the valve spool is shifted to an operating position to the left of neutral. In that position, the valve spool directs supply fluid into the rod end of the cylinder and motor exhaust fluid to another exhaust passage 36 which joins with the bore 12 alongside the service passage branch 13.

An important feature of this invention resides in the fact that the flow of supply fluid to either end of the cylinder can be reduced and more or less coordinated with exhaust flow from the cylinder whenever such exhaust flow is restricted by the flow control valve on the return side. For this purpose, the bypass valve 30 can be made to function as a flow coordinating valve, through the provision of means to enable its chamber 31 to be vented through a second venting passageway which includes portions of the passages 22 and 23, and a bypass 49 to communicate said passages with one another under the control of a pilot valve 50. A spring 51 acts upon the pilot valve to yieldingly hold it in a position closing the second venting passageway. When the pilot valve is opened, of course, the bypass valve 30 can be unseated by force which pressure fluid in the supply passage 15 exerts thereon.

One end portion of the pilot valve provides a piston which is slidable in a chamber 52. This chamber is selectively communicable with the inner sevice passage branches 13 and 14, to be pressurized by exhaust fluid therein. For that purpose, the chamber 52 is communicated by a duct 53 with an enlargement 54 of the bore 12, located adjacent to but between two flanking bore enlargements 55 and 56. The enlargement 54 is situated to be in register with the groove 20 in the valve spool 11 when the latter is in its neutral position, but to be then closed off from the flanking enlargements 55,56 by the spool lands at either side of the groove 20.

A first control line 57 connects the bore enlargement 55 with service passage branch 13, while a second control line 58 connects the bore enlargement 56 with service passage branch 14. Hence, when the valve spool 11 is shifted to its right hand operating position at which pump fluid can flow from supply passage 15 to service passage 13, the other service passage 14 will be communicated with the pilot valve chamber 52 by the valve spool 11, to maintain said chamber at the same pressure as in service passage branch 14. Similarly, the chamber 52 will be maintained at the pressure of return fluid obtaining in service passage branch 13 when the valve spool is in an operating position at which supply fluid can flow to service passage branch 14.

In either event, therefore, the piston on the pilot valve will be subjected to valve unseating force by the pressure of motor exhaust fluid in one or the other of the inner service passage branches 13 or 14. The force of the pilot valve spring 51 will be overcome by the fluid pressure force exerted on the pilot valve, and the latter will open, at times when the pressure of motor exhaust fluid in the inner service passage branches 13,14 is at the predetermined maximum value allowed by the flow control valves 40.

As a result of such opening of the pilot valve 50 the second venting passage for the bypass valve 30 will be opened to allow of unseating of bypass valve 30 for flow of some of the pressure fluid in the supply passage 15 to tank. This, of course, reduces the flow of supply fluid to the cylinder in correspondence with restriction of exhaust flow from the cylinder.

The same desirable results are forthcoming with the slightly modified form of the invention disclosed in FIG. 2. As therein seen, a separate unloading valve 60 is provided to bypass the pump output to tank in the neutral position of the valve spool. Also, a somewhat different pilot valve mechanism 61 is provided to control venting of the chamber 31 in which the bypass valve 30 operates.

The unloading valve 60 is generally like the bypass valve 30 in that it comprises an axially slidable hollow poppet 62 urged by a spring 63 to a position in a chamber 64 closing a bypass 65 connecting the supply passage 15 with return passage means afforded by a tank passage 66. A hole or orifice in the front of the poppet allows fluid from the supply passage to gain entry to the space in chamber 64 behind the poppet where it can exert force upon the poppet and hold it closed in either operating position of the valve spool 111. When the spool is in neutral, of course, the chamber 64 is vented, and the unloading poppet is moved off of its seat by pressure of supply fluid acting upon its front, to cause the pump output to be dumped to tank.

The unloading valve chamber is vented through a control duct 68 which leads to an enlargement 69 of the bore 12 containing the valve spool 111. A circumferential groove 70 in spool 111 normally communicates the enlargement 69 with an exhaust passage 71 that intersects the bore 12 at a location between the enlargement 69 and the junction of the bore with inner branch 13 of the left hand service passage. The lands on the spool at each side of the groove 70 therein will close off communication between the venting duct 68 and the exhaust passage 71 when the valve spool is moved out of its neutral position to one or the other of its operating positions, to thus effect closure of the unloading valve.

The bypass valve chamber 31 is here vented through a passage 73 which leads to the return passage means through the seat of a pilot valve 74. Pressure fluid from the supply passage 15, which is present in the bypass valve chamber 31, also exerts opening force on the pilot valve, against the force of a spring 75 acting upon the latter. The spring 75, however, is strong enough to hold the pilot valve closed during all normal operation of the system.

It is only when the pressure of motor exhaust fluid in either service passage branch 13 or 14 rises to the predetermined maximum value permitted by the flow control valve mechanisms 40 that the pilot valve 74 will be caused to open under pressure of fluid in the bypass valve chamber 31. This is accomplished by subjecting a control piston 77 in a cylinder 78 to the pressure of exhaust fluid obtaining in either passage branch 13 or 14, by means of a control passage 79 having branches 80 an 81 which intersect the bore 12 at locations between the service passages 13,14 and their respective exhaust passages 71. Hence circumferential grooves 82 and 83 provided in the spool 11 can communicate the cylinder 78 with one or the other of the service passage branches 13,14 when the valve spool is shifted to its operating positions described earlier.

The piston 77 is normally held in one limit of motion in its cylinder by a spring 85. It also has a pilot portion 86 which is slidably received in the bore 87 containing the pilot valve 74 and which provides a seat for the pilot valve spring 75. The piston spring 85 thus normally holds the pilot valve spring 75 in a loaded condition. The pilot valve spring 75 can be relaxed, however, as a consequence of actuation of the piston 77 in a direction counter to the force of its spring 85, by motor exhaust fluid in service passage branch 13 or 14 at the predetermined maximum pressure value allowed by the associated flow control valve 40. When the piston is moved in this fashion, the pressure of fluid in chamber 31 unseats the pilot valve to thereby vent said chamber and allow the bypass valve to open for flow of some of the pump fluid in the supply passage to tank. This again serves to reduce the flow of supply fluid to the cylinder 5 at the time one or the other of the flow control valves 40 is limiting flow of motor exhaust fluid to tank.

From the foregoing description, together with the accompanying drawings, it will be readily apparent to those skilled in the art that this invention serves to prevent operation of a fluid motor at undesirably high speeds by limiting exhaust flow from the motor; and that supply flow to the motor is also curtailed at such times as the exhaust flow from the motor is restricted.

The invention is defined by the following claims:

1. In combination:

A. a control valve having a valve element movable from a neutral position to an operating position at which it directs pressure fluid from a supply passage to one of a pair of service passages while directing exhaust fluid in the other service passage to a tank passage;

B. a flow control valve for said other service passage operable to prevent rise in pressure of exhaust fluid therein above a predetermined value;

C. a tank port which is connectible with said supply passage;

D. a valve mechanism having a valve member which can be opened by supply fluid pressure to communicate the supply passage with said tank port except at times when a venting passage for a chamber in which the valve member operates is closed;

E. and means controlling the effectiveness of said venting passage comprising 1. a pilot valve which can be opened under the action of supply fluid pressure thereon,
2. a spring to normally hold the pilot-valve in a position closing said venting passage,
3. a cylinder having a piston therein providing a seat for said spring,
4. a spring member acting upon the piston in a direction to yieldingly maintain the same in a position at which it loads the pilot valve spring and thereby holds the pilot valve in position closing said venting passage, 5. and means for moving the piston in the opposite direction to relax the pilot valve spring in consequence of pressure in said other service passage in excess of said predetermined value.

2. The combination of claim 1, further characterized by:

A. an unloading valve which can be opened by supply fluid pressure providing a chamber in which the unloading valve operates is vented;

B. and means providing a venting passage for said unloading valve chamber which is open in the neutral position of the valve element but is closed thereby in said operating position of the valve element.

3. In combination with a control valve having a valve element movable from a neutral position to a pair of working positions to communicate either of two service passages with a pressure fluid supply passage while communicating the non-selected service passage with return passage means for motor exhaust fluid:

A. flow control valve means effective in one working position of the valve element to maintain the pressure of motor exhaust fluid in that service passage then in communication with the return passage means from rising beyond a predetermined value;

B. means to render said valve means ineffective to influence pressure in said designated service passage when the latter is communicated with the supply passage by the valve element in the other working position thereof;

C. means providing a bypass through which fluid can flow from the supply passage to the return passage means;

D. a valve member to govern said bypass, said valve member operating in a chamber and being spring urged in the bypass closing direction but movable in the bypass opening direction by pressure of fluid in the supply passage in consequence of venting of its chamber;

E. means for venting said chamber whenever the pressure of motor exhaust fluid present in a service passage then communicated with the return passage means rises to said predetermined value;

F. an unloading valve governing a bypass between the supply passage and the return passage means;

G. and means rendered operative by the valve element in the neutral position thereof, for effecting opening of the unloading valve in response to force of supply pressure fluid thereon.

4. In combination with a control valve having a valve element which can be moved from a neutral position to an operating position connecting one of a pair of service passages with an inlet passage and the other service passage with motor exhaust passage means;

A. an exhaust flow control valve for said other service passage, having a valve member which is urged by a spring in one direction toward a position permitting substantially free flow of motor exhaust fluid in said other service passage but which is movable in the opposite direction toward a position restricting such motor exhaust flow in response to rise in exhaust fluid pressure in said other service passage to a predetermined value which exceeds the force of said spring;

B. means for dumping all of the fluid in the inlet passage to the exhaust passage means when said valve element is in said neutral position thereof; said means for dumping including a dumping passage between said inlet passage and said exhaust passage means, a valve member having a first position for closing said dumping passage and being movable away from said first position for permitting flow through said dumping passage, and means operatively controlled by said valve element for causing said valve element to be moved away from said first position thereof when said valve element is in said neutral position thereof; and C. flow coordinating means for bypassing fluid in the inlet passage to the exhaust passage means when said predetermined motor exhaust fluid pressure is attained in said other service passage; said flow coordinating means including a bypass passage between said inlet passage and said exhaust passage means, a valve member for governing said bypass passage, said last mentioned valve member operating in a chamber and being spring urged in the bypass passage closing direction but movable in the bypass passage opening direction in consequence of venting of its chamber, and means sensitive to the pressure in said other service passage for venting said chamber when said predetermined motor exhaust fluid pressure is attained in said other service passage.

5. The combination of claim 4 wherein the valve member of said flow coordinating means is separate from the valve member of said means for dumping fluid, and wherein said means sensitive to the pressure in said other service passage includes pilot valve means movable in response to the attainment of said predetermined exhaust fluid pressure.

* * * * *